US010881181B2

(12) United States Patent
Cardona

(10) Patent No.: US 10,881,181 B2
(45) Date of Patent: Jan. 5, 2021

(54) GARMENT HANGER

(71) Applicant: John Cardona, San Antonio, TX (US)

(72) Inventor: John Cardona, San Antonio, TX (US)

( * ) Notice: Subject to any disclaimer, the term of this patent is extended or adjusted under 35 U.S.C. 154(b) by 218 days.

(21) Appl. No.: 15/482,987

(22) Filed: Apr. 10, 2017

(65) Prior Publication Data

US 2018/0055169 A1 Mar. 1, 2018

Related U.S. Application Data

(60) Provisional application No. 62/380,589, filed on Aug. 29, 2016.

(51) Int. Cl.

| | |
|---|---|
| ***A45C 13/00*** | (2006.01) |
| ***A45C 13/30*** | (2006.01) |
| ***A47G 25/32*** | (2006.01) |
| ***A45F 3/00*** | (2006.01) |

(52) U.S. Cl.

CPC ..... *A45C 13/001* (2013.01); *A45C 13/30* (2013.01); *A47G 25/32* (2013.01); *A45C 2013/306* (2013.01); *A45F 2003/003* (2013.01)

(58) Field of Classification Search

CPC ..... B65D 85/185; B65D 85/18; A47C 3/004; A47C 13/03; A47G 25/54; A47G 25/14; A45F 2003/003

USPC ..... 206/279, 278; 223/85, 87; 24/302; 248/214

See application file for complete search history.

(56) References Cited

U.S. PATENT DOCUMENTS

| | | | | | |
|---|---|---|---|---|---|
| 279,706 | A | * | 6/1883 | Carroll | |
| 910,238 | A | * | 1/1909 | Shaw | |
| 3,193,235 | A | * | 7/1965 | Jensen | A47G 25/1478 211/119.12 |
| 3,433,335 | A | * | 3/1969 | Spitz | A45C 3/004 206/287.1 |
| 3,559,853 | A | * | 2/1971 | Strassman | A45F 5/00 224/258 |
| 3,610,684 | A | * | 10/1971 | Richter | B60J 11/06 296/132 |
| 3,831,740 | A | * | 8/1974 | Pendergast | A47G 25/54 190/903 |
| 4,788,941 | A | * | 12/1988 | Villeneuve | A47D 13/086 119/857 |
| 5,031,766 | A | | 7/1991 | Cohen | |
| 5,326,175 | A | * | 7/1994 | Carter | A01D 75/008 224/401 |
| 5,582,337 | A | * | 12/1996 | McPherson | A45F 3/14 224/660 |

(Continued)

*Primary Examiner* — Tri M Mai

(74) *Attorney, Agent, or Firm* — Boudwin Intellectual Property; Daniel Boudwin

(57) ABSTRACT

A garment hanger. The garment hanger includes a body having a triangular perimeter. A first end of a strap is connected to an apex portion of the body. A slide adjuster is disposed on the strap and configured to adjust the length thereof. A fastener is disposed on a second end of the strap, and a strap connector is disposed on the strap between the first end and the second end. The strap is configured to maintain an open loop configuration when the fastener is connected to the strap connector, such that a garment may be hung on a horizontal rod. In one embodiment, the garment hanger includes a bag having a bag connector thereon, wherein the fastener is removably securable to the bag connector, so that a garment may be hung from the bag.

6 Claims, 2 Drawing Sheets

(56) References Cited

U.S. PATENT DOCUMENTS

| | | | | |
|---|---|---|---|---|
| 5,622,255 | A | 4/1997 | Riccoboni | |
| 5,628,398 | A * | 5/1997 | Jackson | A45C 3/004 190/109 |
| 5,749,325 | A * | 5/1998 | Albanese | A01K 1/04 119/792 |
| 5,779,111 | A * | 7/1998 | Ball | A45C 13/03 223/85 |
| 5,868,369 | A * | 2/1999 | Montgomery | A47G 25/1457 24/298 |
| 6,193,034 | B1 | 2/2001 | Fournier | |
| 6,729,519 | B2 | 5/2004 | Kestler | |
| 7,416,066 | B2 * | 8/2008 | Chernoff | A45C 3/004 190/108 |
| 9,119,448 | B1 | 9/2015 | Hirshberg | |
| 2003/0097736 | A1 * | 5/2003 | Blankenship | A63B 57/00 24/302 |
| 2006/0163301 | A1 * | 7/2006 | Rhodes | A61J 9/06 224/409 |
| 2006/0288960 | A1 * | 12/2006 | Harrison | A01K 27/004 119/794 |
| 2007/0181622 | A1 * | 8/2007 | Rocchio | B60R 9/048 224/324 |
| 2008/0115739 | A1 * | 5/2008 | Clenney | A01K 27/001 119/863 |
| 2014/0096721 | A1 * | 4/2014 | Millard | A01K 27/001 119/792 |

* cited by examiner

GARMENT HANGER

CROSS REFERENCE TO RELATED APPLICATIONS

This application claims the benefit of U.S. Provisional Application No. 62/380,589 filed on Aug. 29, 2016. The above identified patent application is herein incorporated by reference in its entirety to provide continuity of disclosure.

FIELD OF THE INVENTION

The present invention relates to garment hangers. More specifically, the present invention provides a garment hanger that allows garments to be hung from either a bag or a horizontal rod.

BACKGROUND OF THE INVENTION

When individuals go to a gym or perform other strenuous activities, they often bring with them a change of clothes or a towel. Some individuals carry clothes and towels in a bag such as a gym bag. However, carrying clothes in this manner can cause them to be wrinkled or otherwise damaged. Additionally, if an individual showers after performing the strenuous activity, it is undesirable to throw a wet towel into the bag, because it can damage other items in the bag and cause the bag to have an undesirable odor. In light of the above problems, it is desirable to provide a garment hanger that is securable to the exterior of a bag that can also be hung from a horizontal rod similar to a traditional hanger.

In light of the devices disclosed in the prior art, it is submitted that the present invention substantially diverges in design elements from the prior art and consequently it is clear that there is a need in the art for an improvement to existing animal deterring devices. In this regard the instant invention substantially fulfills these needs.

SUMMARY OF THE INVENTION

In view of the foregoing disadvantages inherent in the known types of garment hangers now present in the prior art, the present invention provides a garment hanger wherein the same can be utilized for providing convenience for the user when hanging a garment. The garment hanger includes a body having a triangular perimeter. A first end of a strap is connected to an apex portion of the triangular base member. A slide adjuster is disposed on the strap and configured to adjust the length thereof. A fastener is disposed on a second end of the strap, and a strap connector is disposed on the strap between the first end and the second end. The strap is configured to maintain an open loop configuration when the fastener is connected to the strap connector, such that a garment may be hung on a horizontal rod. In one embodiment, the garment hanger includes a bag having a bag connector thereon, wherein the fastener is removably securable to the bag connector, so that a garment may be hung from the bag.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
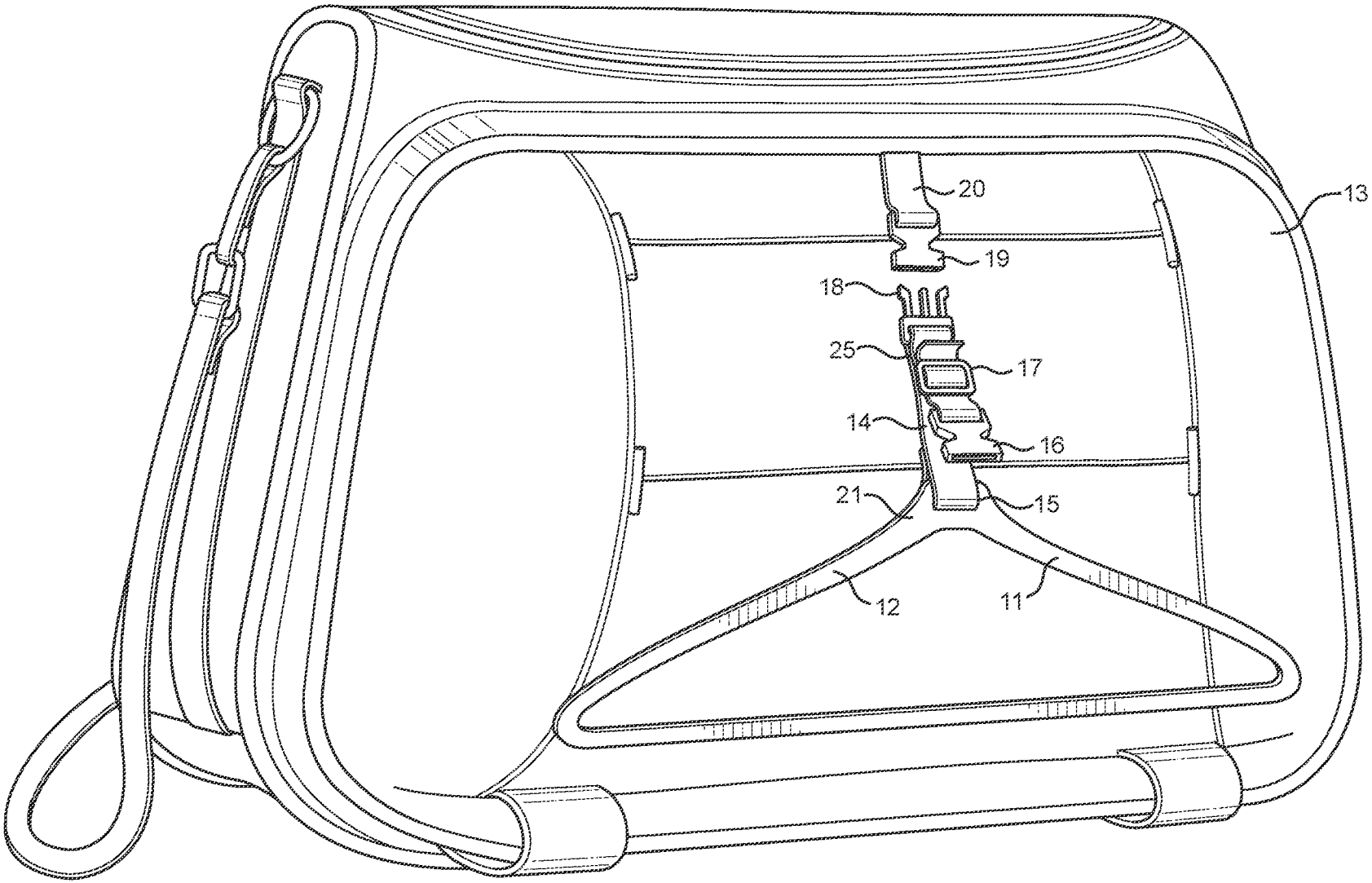
FIG. 1 shows a perspective view of the garment hanger being secured to a bag.

Reference is made herein to the attached drawings. Like reference numerals are used throughout the drawings to depict like or similar elements of the garment hanger. For the purposes of presenting a brief and clear description of the present invention, the preferred embodiment will be discussed as used for hanging garments from a bag or from a horizontal rod. The figures are intended for representative purposes only and should not be considered to be limiting in any respect.

Referring now to FIG. 1, there is shown a perspective view of the garment hanger being secured to a bag. The garment hanger comprises a body 11, which has a triangular perimeter 12 in the shown embodiment. The body 11 includes an opening generally enclosed by the perimeter 12, wherein garments, clothes, and the like may be received therethrough. A first end 15 of a strap 14 is connected to an apex portion 21 of the body 11. In one embodiment, the first end 15 of the strap 14 may be threaded through an opening on the apex portion 21 of the body 11 and secured to another portion of the strap 15 via stitching, adhesive, or the like.

A slide adjuster 17 is disposed on the strap 15. The slide adjuster 17 is configured to adjust the length of the strap 15, so that a user may increase or decrease the length of the strap 14 as needed. A fastener 18 is disposed on a second end 25 of the strap 14. The fastener 18 is a male end of a side release buckle in the shown embodiment, however other suitable fasteners 18 may be utilized. A strap connector 16 is disposed on the strap 14 between the first end 15 and second end 25 thereof. The fastener 18 is removably securable to the strap connector 16. When the fastener 18 is secured to the strap connector 16, the strap 14 maintains an open loop configuration. In the illustrated embodiment, the strap connector 16 is a female end of a side release buckle which receives the corresponding male end side release buckle of the fastener 18.

In the shown embodiment, the garment hanger 11 further comprises an accompanying bag 13 having a bag connector 19 thereon. The bag connector 19 is disposed on an end of a bag connector strap 20 that is connected to an exterior surface of the bag 13. The fastener 18 is removably securable to the bag connector 19, such that a garment may be hung from the bag 13 via the body 11. In the illustrated embodiment, the bag connector 19 is a female end of a side release buckle that receives the corresponding male end side release buckle of the fastener 18.

Figure 2:
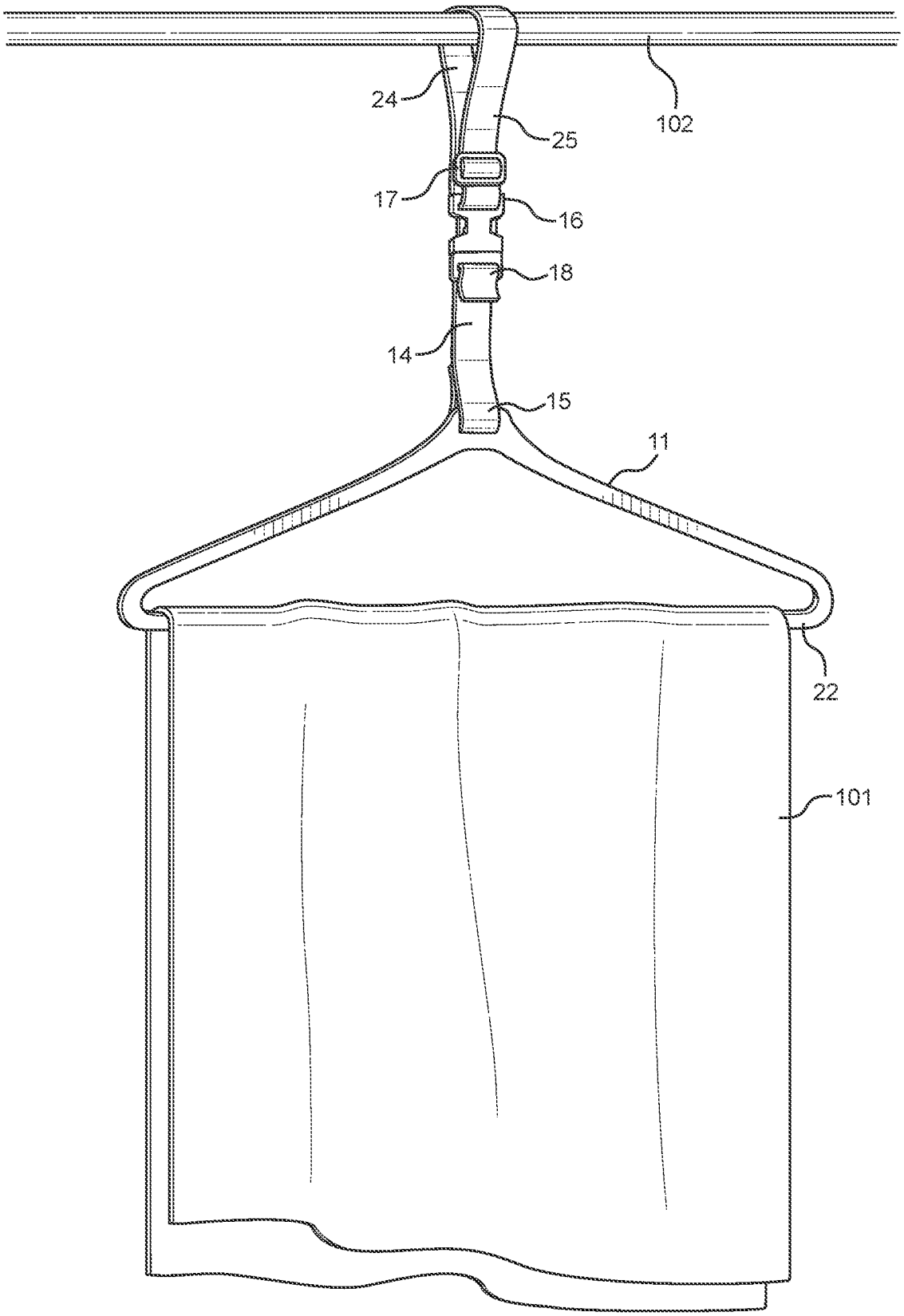
FIG. 2 shows a perspective view of the garment hanger secured to a horizontal rod.

Referring now to FIG. 2, there is shown a perspective view of the garment hanger secured to a horizontal rod. The second end 25 of the strap is placed over a horizontal rod 102. The fastener 18 is connected to the strap connector 16, forming an open loop 24 between the first end 15 and the second end 25 of the strap 14. The horizontal rod 102 supports the body 11 via the open loop 24 of the strap 14. A towel 101 is shown being supported by a lower horizontal portion 22 of the body 11. The slide adjuster 17 may be utilized to increase or decrease the length of the strap 14, so that the towel 101 can be hung at a desired height.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment hanger and bag, consisting of:

a garment hanger consisting of a body consisting of a triangular perimeter;

a strap having a first end and a second end, the first end securely connected to an apex portion of the body;

a slide adjuster configured to adjust a length of the strap, wherein the strap length is fixed until adjusted again;

a connector disposed on the second end of the strap, wherein the connector disposed at the second end of the strap is configured to allow for adjusting the length of the strap via the connector's attachment to the strap;

a strap connector disposed on the strap between the first end and the second end;

wherein the strap is configured to maintain an open loop configuration when the connector disposed on the second end is connected to the strap connector;

a bag including a first fastener;

wherein the garment hanger is removably secured to the bag via the connector of the strap and the fastener of the bag.

2. A garment hanger and bag of claim 1, wherein the connector disposed on the second end is a male end of a side release buckle.

3. A garment hanger and bag of claim 1, wherein the strap connector is a female end of a side release buckle.

4. A garment hanger and bag of claim 1, wherein the body is composed of metal.

5. A garment hanger and bag of claim 1, wherein the body is composed of plastic.

6. A garment hanger and bag of claim 1, wherein the fastener is a male end of a side release buckle and the bag connector is a female end of a side release buckle.

* * * * *